US008016026B2

(12) United States Patent
Joseph

(10) Patent No.: US 8,016,026 B2
(45) Date of Patent: Sep. 13, 2011

(54) ACTUATOR FOR DOWNHOLE TOOLS

(75) Inventor: Paul Joseph, Missouri City, TX (US)

(73) Assignee: Baker Hughes Incorporated, Houston, TX (US)

( * ) Notice: Subject to any disclaimer, the term of this patent is extended or adjusted under 35 U.S.C. 154(b) by 184 days.

(21) Appl. No.: 12/277,949

(22) Filed: Nov. 25, 2008

(65) Prior Publication Data

US 2010/0126716 A1 May 27, 2010

(51) Int. Cl.
*E21B 41/00* (2006.01)

(52) U.S. Cl. ..... 166/66.5; 166/66.7

(58) Field of Classification Search ..... 166/66.5, 166/66.6, 66.7

See application file for complete search history.

(56) References Cited

U.S. PATENT DOCUMENTS

| | | | | |
|---|---|---|---|---|
| 2,806,533 | A * | 9/1957 | Fleck | 166/249 |
| 3,906,435 | A * | 9/1975 | Lamel et al. | 367/81 |
| 4,393,598 | A * | 7/1983 | Powell et al. | 33/302 |
| 4,579,173 | A | 4/1986 | Rosensweig et al. | |
| 4,875,292 | A | 10/1989 | Gibson | |
| 5,878,851 | A | 3/1999 | Carlson et al. | |
| 6,095,486 | A | 8/2000 | Ivers et al. | |
| 6,131,709 | A | 10/2000 | Jolly et al. | |
| 6,158,470 | A | 12/2000 | Ivers et al. | |
| 6,234,060 | B1 * | 5/2001 | Jolly | 91/361 |
| 6,257,356 | B1 | 7/2001 | Wassell | |
| 6,308,813 | B1 | 10/2001 | Carlson | |
| 6,795,373 | B1 | 9/2004 | Aronstam | |
| 6,926,089 | B2 | 8/2005 | Goodson, Jr. et al. | |
| 7,012,545 | B2 * | 3/2006 | Skinner et al. | 340/855.8 |
| 7,097,212 | B2 | 8/2006 | Willats et al. | |
| 7,291,028 | B2 * | 11/2007 | Hall et al. | 439/194 |
| 7,428,922 | B2 * | 9/2008 | Fripp et al. | 166/66.5 |
| 7,646,310 | B2 * | 1/2010 | Close | 340/854.3 |
| 2002/0011358 | A1 | 1/2002 | Wassell | |
| 2003/0192687 | A1 | 10/2003 | Goodson, Jr. et al. | |
| 2005/0028522 | A1 * | 2/2005 | Fripp et al. | 60/533 |
| 2007/0125578 | A1 | 6/2007 | McDonald et al. | |

FOREIGN PATENT DOCUMENTS

| | | |
|---|---|---|
| EP | 0581476 A1 | 2/1994 |
| GB | 2352464 A | 1/2001 |
| WO | 9922383 A1 | 5/1999 |

OTHER PUBLICATIONS

Carlson, J.D.; Catanzarite, D.M. and St.Clair, K.A.; Commercial Magneto-Rheological Fluid Devices; 5th Int. Conf. on Electro-Rheological, Magneto-Rheological Suspensions and Associated Technology Sheffied, pp. 10-14; Jul. 1995.

Engineering Note; "Designing with MR Fluids", Lord Corporation, Thomas Lord Research Center, May 1998.

Jolly, Mark R.; Bender, Jonathan, W., and Carlson, J. David, "Properties and Applications of Commercial Magnetorheological Fluids", SPIE 5th Annual Int. Symposium on Smart Structures and Materials, San Diego, CA; pp. 1-15; Mar. 15, 1998.

* cited by examiner

*Primary Examiner* — Kenneth Thompson

(74) *Attorney, Agent, or Firm* — Mossman, Kumar & Tyler, PC

(57) ABSTRACT

An apparatus, method, and system for actuating a wellbore tool includes a body having a chamber in which a movable member is disposed. The movable member may connect to a selected wellbore tool. Within the chamber is a controllable fluid that substantially prevents relative movement between the body and the movable member when exposed to an applied magnetic field. A generator applies the magnetic field to the fluid and may change the applied magnetic field in response to a first control signal to release the movable member from the body. A driver displaces the movable member relative to the body once the movable member is released from the body.

20 Claims, 3 Drawing Sheets

ACTUATOR FOR DOWNHOLE TOOLS

CROSS-REFERENCE TO RELATED APPLICATIONS

None.

BACKGROUND OF THE DISCLOSURE

1. Field of the Disclosure

The present invention relates to the selective actuation of wellbore tools.

2. Description of the Related Art

To recover subsurface economic minerals and fluids such as hydrocarbons, the art of earth-boring involves many operations that are carried out using tools deployed in wells that may be tens of thousands of meters deep. During operation, many of these tools shift between two or more positions either autonomously or in response to a control signal. For example, a valve may shift from an open position to a closed position. The failure of such tools to operate as intended may result in losses of thousands of dollars to a well owner. Thus, there is a need to provide devices, systems and methods that provide more reliable and accurate operation of such tools.

SUMMARY OF THE DISCLOSURE

In one aspect, the present disclosure provides an apparatus for actuating a wellbore tool. In one embodiment, the apparatus includes a body having a chamber in which a movable member is disposed. The movable member may connect to a selected wellbore tool. Within the chamber is a controllable fluid that substantially prevents relative movement between the body and the movable member when exposed to an applied magnetic field. The apparatus includes a generator that applies the magnetic field to the fluid and that changes the applied magnetic field in response to a first control signal. A driver displaces the movable member relative to the body once the movable member is released from the body.

In another aspect, the present disclosure provides a method for actuating a wellbore tool. The method may include disposing a movable member in the chamber formed in a body; connecting the movable member to the wellbore tool; filling the chamber with a controllable fluid that substantially prevents relative movement between the body and the movable member when exposed to an applied magnetic field; applying the magnetic field to the fluid; changing the magnetic field applied to the fluid to allow relative movement between the body and the movable member; and displacing the movable member relative to the body.

In still another aspect, the present disclosure provides a system for actuating a wellbore tool. The system may include a controller positioned at a surface location; a control line operably connected to the controller; and an actuator operably connected to the control line and responsive to control signals transmitted by the controller. The actuator may include a body having a chamber; a movable member connected to the wellbore tool and disposed in the chamber. The chamber has a controllable fluid that prevents relative movement between the body and the movable member when exposed to an applied magnetic field. The actuator also includes a generator that applies the magnetic field to the fluid, and that changes the applied magnetic field in response to a first control signal; and a driver configured to displace the movable member.

It should be understood that examples of the more illustrative features of the disclosure have been summarized rather broadly in order that detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

The advantages and further aspects of the disclosure will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION OF THE PREFERRED EMBODIMENTS

Figure 1:
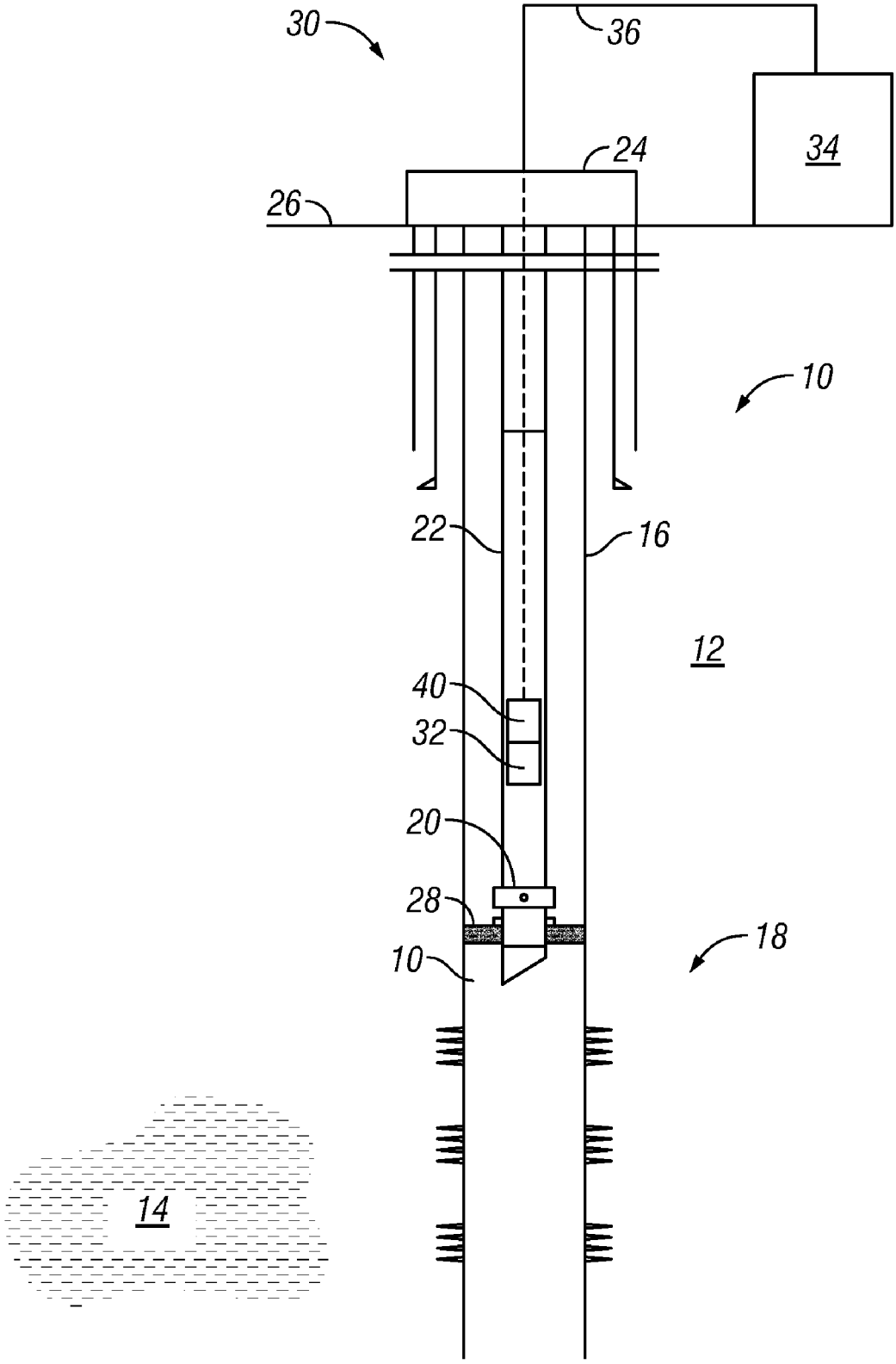
FIG. 1 is a schematic elevation view of an exemplary production well that incorporates an actuator in accordance with one embodiment of the present disclosure.

The present disclosure relates to devices and methods for controlling or actuating wellbore tools. As used herein, the term "actuate" or "actuating" refers to shifting, moving, reorienting, initiating operation, terminating operation, etc. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein.

The devices, methods and systems of the present disclosure may be utilized in a variety of subsurface applications. These applications may include drilling of a well and subsequent logging, completion, recompletion, and/or work-over. Additionally, the present teachings may be advantageously applied to intelligent well production. Merely for context, the present disclosure will be described in the context of a rather simplified well 30 depicted in FIG. 1. In FIG. 1, there is shown an exemplary wellbore 10 that has been drilled through the earth 12 and into a formation 14 from which it is desired to produce hydrocarbons. The wellbore 10 may be cased by metal casing 16, as is known in the art, and a number of perforations 18 penetrate and extend into the formation 14 so that production fluids may flow from the formation 14 into the wellbore 10. The wellbore 10 may include a late-stage production assembly, generally indicated at 20, disposed therein by a tubing string 22 that extends downwardly from a wellhead 24 at the surface 26.

The well 30 may include a tool 32 that shifts between two or more operating states or positions when actuated. The tool 32 may be controlled by a surface controller 34 that transmits a control signal via one or more conductors 36 to an actuator 40 that controls the operation of the associated tool 32. Exemplary tools 32 include, but are not limited to, valves, sensors, setting tools, formation evaluation tools, perforating devices, pumps, packers, etc. In one embodiment, the tool 32 may be conveyed into the wellbore 10 in an un-energized state. For instance, a valve may conveyed in a latched and closed position. After being appropriately positioned, the controller 34 may be used to transmit control signals to an actuator 40 associated with the tool 32. In one embodiment, the signals may be electrical current. For instance, upon receiving a first signal, the actuator 40 may shift from being in a latched or locked position to an unlatched position. For example, a valve may be unlocked and free to move. As the first signal is being applied, the controller 34 may send a second signal to shift the tool 32 from a first position to a second position. For example, the valve may move from a closed position to an open position. Terminating the first signal will latch or secure the tool 32 in the second position. Thereafter, the controller 34 may send a first signal and a third signal. These signals may unlatch the tool 32 and allow the tool to move from the second position to a third position or to reset to the first position. Thus, in embodiments, the first signal may be used to unlatch or free the tool 32 for movement, and subsequent signals may be used to shift the tool 32 between two or more positions.

Figure 2:
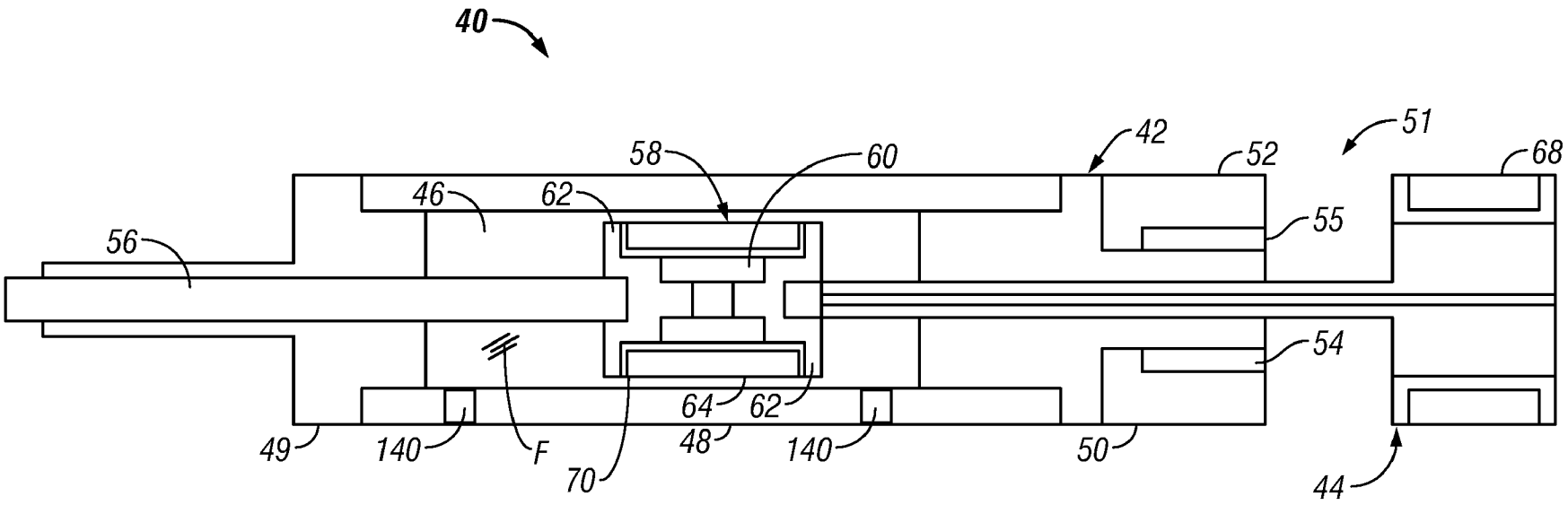
FIG. 2 is a schematic cross-sectional view of an exemplary actuator made in accordance with one embodiment of the present disclosure.

Referring now to FIG. 2, there is shown one embodiment of an actuator 40 that may be utilized to actuate a suitable downhole tool, such as a valve. In one embodiment, the actuator 40 utilizes shaped magnetic flux lines and a fluid, such as a Magnetorheological fluid, to control frictional forces between two components. The magnetic flux generators may be either permanent or electromagnets. Movement or displacement of the movable components of the tool may be controlled by shaping and directing the magnetic flux lines from the flux generators. Flux lines may be shaped such that the magnetically permeable particles present in the fluid vary frictional forces in a manner that allows incremental movement and to hold or anchor the moving member in place.

As used herein, the term "controllable fluids" refer to materials that respond to an applied energy field, such as an electric or magnetic field, with a change in their rheological behavior. Typically, this change is manifested when the fluids are sheared by the development of a yield stress that is more or less proportional to the magnitude of the applied field. These materials are commonly referred to as electrorheological (ER) or magnetorheological (MR) fluids.

In one arrangement, the actuator 40 includes a housing 42 and a movable member 44 that may move within the housing 42. While the shown embodiment utilizes an axial or translating motion, other types of motion such as rotational motion or lateral motion may also be utilized. Also, it should be understood that such motion is relative. That is, in some embodiments, the movable member 44 may be fixed or stationary and the housing 42 slides or moves to actuate a tool. In other embodiments, the housing 42 may be fixed or stationary and the movable member 42 moves to actuate a tool. In still other embodiments, both the movable member 44 and the housing 42 may both be non-stationary. Moreover, the housing 42 may be any body that can be configured to receive the movable member 44. While a tubular structure is shown, the body of the housing 42 may take on any number of shapes or configurations.

In the embodiment shown, the housing 42 may include a chamber 46 in which the movable member 44 is disposed and which is filled with a controllable fluid F. The fluid F may be a magnetorheological fluid that has entrained magnetic filings. The housing 42 also include a centrally positioned pole element 48, an end cap 49, and a magnetic end cap 50. The magnetic end cap 50 may have a pole element 52 and a magnetic element 54. The pole element 52 may be designed such that the flux lines generated by the magnet element 54 are highest at an exposed end 55 of the magnetic element 54. The movable member 44 includes a guide member 56 that may be fixed or coupled to a movable component of a tool, e.g., a sleeve of a valve a sliding-sleeve valve. The movable member 44 also includes a magnetic flux generator 58 that includes a magnet 60, a pair of pole elements 62 and a magnetic wire element 64, which may be a coiled or wound metal conductors. On the end opposite of the guide member 56, the movable member 44 has a magnetic wire element 68. The wire elements 68 and 64 may be separately connected to the conductors 36 (FIG. 1). The magnetic wire 68 and the magnetic end cap 50 operate as a driver 51 that can move or displace the movable member 44 using a magnetic biasing force to be described in greater detail below.

In embodiments, the magnetic flux generator 58 is separated from the housing 42 by a small annular space or gap 70. The fluid F fills this gap. Additionally, the pole elements 48 and 62 and the magnet 60 are constructed to align the magnetic flux lines along the gap 70 such that the magnetic elements (not shown) in the fluid F arrange themselves in a manner that applies frictional forces to the surfaces of the magnetic flux generator 58 and the housing 42 that define the gap 70. These frictional forces are sufficiently high to prevent relative movement between the movable member 44 and the housing 42. For instance, the flux lines can cause the magnetically soft particles suspended in the Magnetorheological fluid F to concentrate between the magnetic flux generator 58 and the housing 42. Thus, the magnetic field may be considered a signal to which the fluid F, which is typically a liquid, responds by allowing the suspended particles to arrange themselves in a manner that creates the desired frictional forces.

In one mode of operation, the actuator 40, with or without the associated well tool, is conveyed into the well in a de-energized mode wherein no power (e.g., voltage/current) is applied to the magnetic wires 64 and 68. In this de-energized state, the pole elements 48 and 62 and the magnet 60 cause the density of flux lines generated by the magnet to be the highest at the gap 70 between the generator 58 and the pole element 48. The magnetic elements (not shown) in the fluid F generate frictional forces that are sufficient to lock or latch the movable element 44 to the housing 42. The locking or latching need not be a totally rigid and prevent all relative movement. Rather, the prevention of relative movement should be substantial enough to prevent undesired or unintentional actuation of a wellbore device. Rather, the Thus, in this de-energized state, there is substantially no movement between the movable element 44 and the housing 42.

In one energized mode, to activate the actuator 40, the surface controller 34 may transmit control signals in the form of electrical power via the conductors 36 (FIG. 1) to the magnetic flux generator 58 and the driver 51. In response, the wire 64 of the magnetic flux generator 58 generates flux lines that oppose those of the magnet 60. This forces the flux lines generated by the magnet 60 to change direction in the pole elements 62 and seek the path of least resistance, which is through the bore of magnet 62. This cancels and re-configures the field strength between the pole elements 62 and housing pole element 48, which in turn causes a redistribution of magnetic particles in the fluid F and a corresponding drop in the frictional forces locking the housing 42 to the movable member 44. Thus, the housing 42 is now free to move relative to the movable member 44. Also in the energized state, the control signal transmitted by the surface controller 34 activates the magnetic wire 68 of the driver 51. When so activated, the wire 38 creates flux lines attracting those generated by the magnetic element 54 of the magnetic end cap 50. The magnetic forces pull the housing 42 to the right if the movable member 44 is fixed, or pull the movable member to the left if the housing 42 is fixed. After the desired amount of movement has been completed, power supply to the wires 64, 68 is terminated. This causes flux lines from the magnet 60 to reorient/realign causing the suspended magnetic particles to again concentrate at the gap 70 between the pole pieces and the return pole. The frictional force caused by this concentration of particles again restricts relative movement between the housing 42 and the movable member 44.

In another energized mode, to move the housing 42 to the left or the movable member 44 to the right, power, which acts as a control signal, may be supplied by the surface controller 34 via the conductors 36 (FIG. 1) to the wires 64 and 68. As in the previously described energized mode, the modified or changed field strength between the pole elements 48 and 62 permits free relative movement between the housing 42 and the movable element 44. Also, power supplied to the outer magnet wire 68 creates flux lines repelling those generated by magnetic element 54. This may be accomplished, for instance, by supplying power at an opposite polarity of that in the previously-described mode of operation. The driver 51 generates magnetic forces that urge or push the housing 42 to the left, or the movable member 44 to the right. After the desired amount of movement has been completed, power supply to the wires 64, 68 is terminated. This causes flux lines from the magnetic element 60 to reorient/realign causing the suspended magnetic particles to again concentrate at the gap 70 between the pole element 62 and the pole element 48. The frictional force caused by this concentration of particles again restricts relative movement between the housing 42 and the movable member 44. It should be appreciated that the above process may be repeated as many times as desired.

Figure 3:
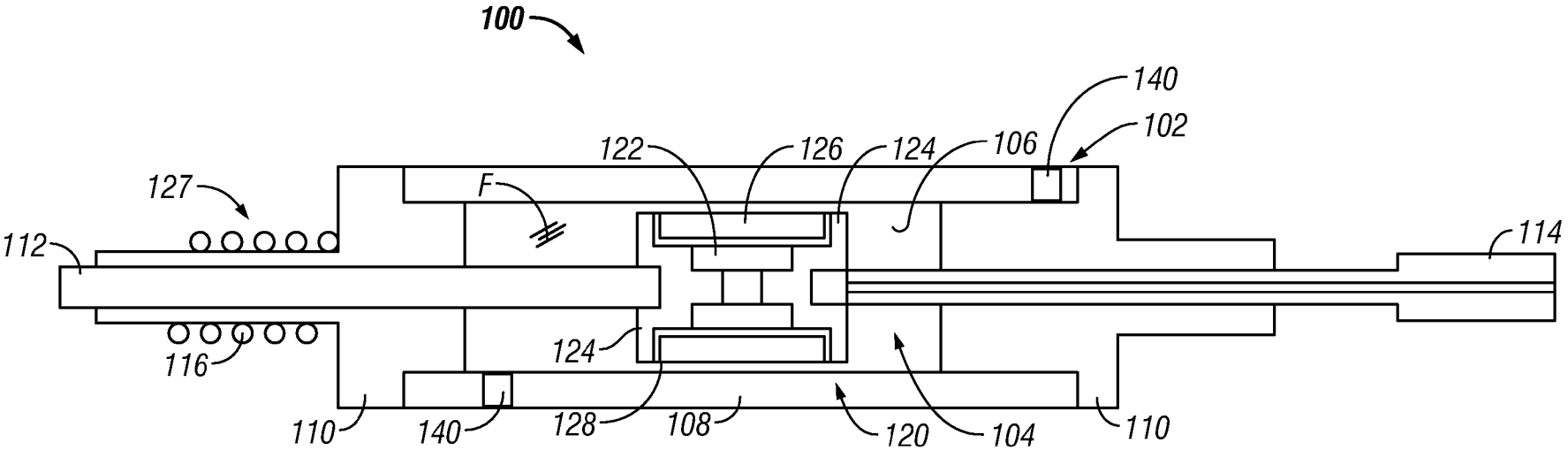
FIG. 3 is a schematic cross-sectional view of another exemplary actuator made in accordance with one embodiment of the present disclosure.

Referring now to FIG. 3, there is shown another embodiment of an actuator 100 that may be utilized to actuate a suitable downhole tool, such as a valve. In a manner described previously, the actuator 100 utilizes a controllable fluid and shapes flux lines to control relative movement between two elements.

In one arrangement, the actuator 100 includes a housing 102 and a movable member 104 that may move within the housing 102. While the shown embodiment utilizes an axial or translating motion, other types of motion such as rotational motion or lateral motion may also be utilized. Also, it should be understood that such motion is relative and that either or both of the housing 102 and the movable member 104 can move.

In the embodiment shown, the housing 102 may include a chamber 106 in which the movable member 104 is disposed and which is filled with a controllable fluid F. The fluid F may be a magnetorheological fluid that has entrained magnetic filings. The housing 102 also include a centrally positioned pole element 108 and end caps 110. The movable member 104 includes guide members 112, 114, either or both of which may be coupled to a wellbore tool. The movable member 104 also includes a magnetic flux generator 120 that includes a magnet 122, a pair of pole elements 124 and magnetic wire elements 126, which may wound metal wires. A driver 127 includes a biasing member 116 that may be positioned on the guide member 112 to apply a biasing force to the housing 102 and/or the movable member 104 in a manner described below. The wire elements 126 may be connected to the conductors 40 (FIG. 1).

In embodiments, the magnetic flux generator 120 is separated from the housing 102 by a small annular space or gap 128 that is filled with the fluid F. Additionally, the pole elements 108 and 124 and the magnet 122 are constructed such that the magnetic flux lines along the gap 128 are aligned such that the magnetic elements (not shown) in the fluid F arrange themselves such that the frictional forces applied by the fluid F to the surfaces of the magnetic flux generator 120 and the housing 102 are sufficiently high to prevent relative movement between the movable member 104 and the housing 102.

In one mode of operation, the actuator 100, with or without the associated well tool, is conveyed into the well in a de-energized mode wherein no power (e.g., voltage/current) is applied to the wire 126. The biasing member 116 may be compressed between the housing 102 and a stationary element (not shown) or compressed between a stationary housing 102 and collar (not shown) or other suitable feature on the movable member 104. In the former arrangement, the compression causes a biasing force to be applied to the housing 102 and in the latter arrangement, the compression causes a biasing force to be applied to the movable member 104. In this de-energized state, the pole elements 124 and 108 and the magnet 122 cause the density of flux lines generated by the magnet to be the highest at the gap 128 between the magnetic flux generator 120 and the pole element 108. The frictional forces along the gap 128 are sufficiently high to withstand the biasing force applied by the biasing member 116. Thus, in this de-energized state, there is substantially no movement between the movable member 104 and the housing 102.

In an energized mode, to activate the actuator 100, the surface controller 34 supplies power supplied via the conductors 36 (FIG. 1) to the wire elements 126. The flux lines generated by the wire 126 oppose those of the magnet 122. This forces flux lines generated by the magnet 122 to change direction in the pole elements 124 and seek the path of least resistance, which is through the bore of magnet 122. This cancels and weakens the field strength between the pole elements 124 and housing pole element 108, which in turn causes a redistribution of magnetic particles in the fluid F and a corresponding drop in the frictional forces locking the housing 102 to the movable member 104. Thus, the housing 102 is now free to move relative to the movable member 104. Thereafter, the biasing force applied by the biasing member 116 overcomes the frictional forces and causes the housing 102 to move to the right if the movable member 104 is fixed, or the movable member 102 to move to the left if the housing 102 is fixed. After the desired amount of movement has been completed, power supply to the wires 126 is terminated, which restricts relative movement between the housing 102 and the movable member 104 in a manner previously described.

It should be understood that FIGS. 2 and 3 are merely illustrative of the arrangements and devices within the scope of the present disclosure. For instance, a biasing member and a magnetic reset mechanism may be utilized in a single actuator. Moreover, while a biasing element is depicted as a spring, in embodiments, a high pressure fluid may also be utilized to provide the desired biasing force. Furthermore, in some embodiments, a surface power source may both energize and control an actuator. In other embodiments, a downhole power source, which may include a battery, may be supply power and a surface controller may provide control signals. In still other embodiments, both the power source and a controller may be downhole. For instance, a downhole controller may be programmed to operate in conjunction with a timer or signals from a sensor, e.g., a pressure sensor or a temperature sensor. In still other variants, the magnetic flux generator 58 may be formed on the housing 42 instead of on the movable member 44. In still other variants, the driver 51 does not necessarily require the use of a biasing force. For instance, other drive mechanisms may be used to move the movable member 44; e.g., an electric motor and a geared drive unit, a solenoid-type device, a pyrotechnic element, a hydraulic piston-cylinder arrangement, etc. Further, the driver 51 may be configured to provide incremental movement. That is, rather than a complete stroke, the driver 51 may be configured to provide two or more incremental or segmented movements. For instance, the magnetic attraction or repulsion generated by the driver 51 may be varied to provide a stepped movement of the movable member 44.

In still further embodiments, the actuators 40, 100 may utilize sensors 140 that are configured to measure or detect one or more parameters of interest. For instance, the sensors 140 may be position sensors that provide signals as to the position of the movable member 44, 104. The sensors may also provide data relating to pressure, temperature, or other parameters that relate to operating status, health, condition, or status of the actuators 40, 100. The sensors 140 may communicate with the surface controller 34. For instance, the controller 34 may use to signals from the sensors 140 to determine when to supply or terminate the supply of power to the actuators 40, 100.

Furthermore, in certain embodiments, other materials may be used to provide specified amounts of friction between the housing and the movable member. For instance, in addition to electrorheological fluids that are responsive to electrical current and magnetorheological fluids that are responsive to a magnetic field, solid materials, such as piezoelectric materials that responsive to an electrical current, may be utilized to selective lock or latch the housing to the movable member. In embodiments wherein a material is responsive to an electrical current, the magnetic flux generator may be reconfigured to selectively apply electrical current to the ER fluid in the cavity. That is, the ER fluid may be configured to provide high frictional forces when de-activated and provide lower frictional forces when subjected to an electrical current. Each of these materials exhibit a change in response to an applied energy field. This change can be a change in dimension, size, shape, viscosity, or other material property.

From the above, it should be appreciated that what has been described includes, in part, an apparatus for actuating a wellbore tool. An illustrative apparatus may include a body having a chamber; a movable member disposed in the chamber; a controllable fluid in the chamber that prevents relative movement between the body and the movable member when exposed to an applied magnetic field; a generator that applies the magnetic field to the fluid and that changes the applied magnetic field in response to a first control signal; and a driver that displaces the movable member. In embodiments, a controller may transmit the first control signal to the generator and the generator may change the applied magnetic field in response to the first control signal. The controller may also transmit a second control signal to the driver that causes the driver to displace the movable member relative to the body. In one configuration, the generator may include a magnetic element that applies the magnetic field; and a magnetic wire that generates magnetic flux that counter-acts the magnetic field in response the first control signal. In one arrangement, the driver may include a biasing member that applies a biasing force to the movable member. In another arrangement, the driver may include a magnetic wire coupled to the movable member and a magnetic element positioned on the body. Also, the driver may displace the movable member in a first direction and a second direction. In embodiments, the controllable fluid may be a magnetorheological fluid.

From the above, it should be appreciated that what has been described also includes, in part, a method for actuating a wellbore tool. The method may include forming a chamber in a body; disposing a movable member in the chamber; connecting the movable member to the wellbore tool; filling the chamber with a controllable fluid that substantially prevents relative movement between the body and the movable member when exposed to an applied magnetic field; applying the magnetic field to the fluid; changing the magnetic field applied to the fluid to allow relative movement between the body and the movable member; and displacing the movable member relative to the body. In one embodiment, a generator generates the magnetic field. The method may also include controlling the generator with a controller positioned at a surface location. The method may further include displacing the movable member relative to the body with a magnetic force and/or a biasing member. Also, the displacing the movable member relative to the body may be done in a first direction and a second direction.

From the above, it should be appreciated that what has been described further includes, in part, a system for actuating a wellbore tool. The system may include a controller positioned in at a surface location; a control line operably connected to the controller; and an actuator operably connected to the control line and responsive to control signals transmitted by the controller. The actuator may include a body having a chamber; a movable member connected to the wellbore tool and disposed in the chamber; a controllable fluid in the chamber that prevents relative movement between the body and the movable member when exposed to an applied magnetic field; a generator that applies the magnetic field to the fluid and that changes the applied magnetic field in response to a first control signal; and a driver configured to displace the movable member. In one arrangement, the control signals may include electrical power. In embodiments, the wellbore tool may be a flow control device.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

I claim:

1. An apparatus for actuating a wellbore tool, comprising:

a body having a chamber;

a movable member disposed in the chamber and configured to connect to the wellbore tool;

a controllable fluid in the chamber, the controllable fluid being configured to substantially prevent relative movement between the body and the movable member when exposed to an applied magnetic field;

a generator configured to apply the magnetic field to the fluid, the generator being further configured to change the applied magnetic field in response to a first control signal; and a driver configured to displace the movable member.

2. The apparatus of claim 1, further comprising: a controller configured to transmit the first control signal to the generator, the generator changing the applied magnetic field in response to the first control signal.

3. The apparatus of claim 2, wherein the controller is configured to transmit a second control signal to the driver, the driver displacing the movable member relative to the body in response to the second control signal.

4. The apparatus of claim 1, wherein the generator includes:

(i) a magnetic element applying the magnetic field; and (ii) a magnetic wire that generates a magnetic flux that alters the magnetic field in response the first control signal.

5. The apparatus of claim 1, wherein the driver includes a biasing member configured to apply a biasing force to the movable member.

6. The apparatus of claim 1, wherein the driver includes a magnetic wire coupled to the movable member and a magnetic element positioned on the body.

7. The apparatus of claim 1, wherein the driver is configured to displace the movable member in a first direction and a second direction.

8. The apparatus of claim 1 wherein the controllable fluid is a magneto rheological fluid.

9. A method for actuating a wellbore tool, comprising:

preventing substantial movement between a movable member and a body having a chamber in which the movable member is disposed using a controllable fluid exposed to a magnetic field;

changing the magnetic field applied to the fluid by counteracting the magnetic field; and displacing the movable member relative to the body.

10. The method of claim 9, wherein a generator generates the magnetic field.

11. The method of claim 10, further comprising controlling the generator with a controller positioned at a surface location.

12. The method of claim 10, wherein the generator includes:

(i) a magnetic element applying the magnetic field; and (ii) a magnetic wire that generates a magnetic flux that counter-acts the magnetic field in response the first control signal.

13. The method of claim 9, wherein displacing the movable member relative to the body is done using a magnetic force.

14. The method of claim 9, wherein displacing the movable member relative to the body is done using a biasing member.

15. The method of claim 9, wherein displacing the movable member relative to the body is done in a first direction and a second direction.

16. The method of claim 9, wherein the controllable fluid is a magnetorheological fluid.

17. A system for actuating a wellbore tool, comprising:

a controller positioned at a surface location;

a control line operably connected to the controller;

an actuator operably connected to the control line and responsive to control signals transmitted by the controller, the actuator including:

a body having a chamber;

a movable member disposed in the chamber configured to connect to the wellbore tool;

a controllable fluid in the chamber configured to substantially prevent relative movement between the body and the movable member when exposed to an applied magnetic field;

a generator configured to apply the magnetic field to the fluid, the generator being further configured to change the applied magnetic field in response to a first control signal; and a driver configured to displace the movable member.

18. The system of claim 17, wherein the control signals include electrical power.

19. The system of claim 17, wherein the controllable fluid is a magnetorheological fluid.

20. The system of claim 17, wherein the wellbore tool is a flow control device.

* * * * *